United States Patent [19]

Morgan et al.

[11] 4,290,348

[45] Sep. 22, 1981

[54] SPRAY BOOTH

[76] Inventors: Gordon L. Morgan; John C. Wood, both of 17 Park Rd., Cheltenham, Victoria, Australia, 3192

[21] Appl. No.: 24,717

[22] Filed: Mar. 28, 1979

[30] Foreign Application Priority Data

Mar. 29, 1978 [AU] Australia ..... PD3794

[51] Int. Cl.[3] ..... F23J 11/00

[52] U.S. Cl. ..... 98/115 SB; 55/227; 55/241; 55/257 R; 55/319; 118/326; 118/DIG. 7; 261/112; 261/DIG. 44

[58] Field of Search ..... 98/115 SB; 261/112, 261/DIG. 44; 55/227, 241, 257 R, 257 MP, 257 PV, 319; 118/326, DIG. 7

[56] References Cited

U.S. PATENT DOCUMENTS

| | | | |
|---|---|---|---|
| 2,227,481 | 1/1941 | Bates | 98/115 SB |
| 2,337,983 | 12/1943 | Fisher | 98/115 SB |
| 2,511,833 | 6/1950 | Beckel et al. | 261/112 |
| 3,390,400 | 6/1968 | Dock | 98/115 SB |
| 3,794,306 | 2/1974 | Engalitcheff, Jr. | 55/257 PV |
| 4,127,106 | 11/1978 | Jensen | 98/115 SB |

FOREIGN PATENT DOCUMENTS

| | | | |
|---|---|---|---|
| 1159084 | 4/1956 | France | 261/DIG. 44 |
| 583435 | 12/1946 | United Kingdom | 261/112 |
| 785498 | 10/1957 | United Kingdom | 98/115 SB |
| 1283202 | 7/1972 | United Kingdom | 98/115 SB |

*Primary Examiner*—Ronald C. Capossela
*Attorney, Agent, or Firm*—Laubscher & Laubscher

[57] ABSTRACT

A water wall spray booth having ducts in which water can be entrained and carried to an upper reservoir characterized in that there is a transverse deflector member whereby the air and water from each of the ducts is deflected forwardly to the upper reservoir from which it passes over the water wall.

10 Claims, 2 Drawing Figures

27
26
21
24
20
34
28
19
37
38
35
39
36
35
12
30
12
16
10
30
31
31
41
17
13
14
15

SPRAY BOOTH

BACKGROUND OF THE INVENTION

This invention relates to an improved spray booth and in particular to an improved spray booth of the water wall type.

Water wall spray booths per se are known and are of one of two types. In the first type the ventilating fan which draws the over-spray into the rear of the booth causes the air in which the over-spray is entrained to move upwardly to exhaust and the water is pumped from a lower reservoir to a tank above the water wall, flows over the water wall down its face and returns to the reservoir. In the second type of water wall spray booth the water in the lower reservoir is entrained in the air passing upwardly through ducts, strikes a deflector plate which lies basically transverse to the wall, the water being delivered to the upper surface of the booth and runs into an upper tank and from there over the water wall. This type of booth is exemplified in British Pat. No. 1283202 to Etablissements Vandercleyen S.A.

It is an object of the invention to provide a water wall spray booth of the second type which has advantages over and beyond those spray booths presently known.

SUMMARY OF THE INVENTION

The invention includes a water wall spray booth having a lower water reservoir which can be considered to define an area, an intermediate plate extending substantially across the width of the booth and above the lower reservoir, at least one duct extending from the reservoir to the intermediate plate, the duct(s) being circular in transverse section and substantially tapering outwardly from the reservoir to the intermediate plate, a deflector located above the top of the duct(s) and extending across the width of the booth, a tank located below and in connection with the intermediate plate and extending across the width of the booth, a water wall located on the tank, an exhaust fan located so as to withdraw air from above the intermediate plate thus causing air to be drawn into the volume above the reservoir and means to control the water level in the reservoir so that air drawn upwardly in the duct(s) by the exhaust fan entrains a required volume of water and after deflection by the deflector can deliver water to the tank which, when full, passes water over the water wall.

Preferably there are a plurality of ducts across the width of the booth and the water wall tank may be fed indirectly from a top holding tank, preferably being fed only from each end thereof.

In order that the invention may be more readily understood and put into practice we shall describe one particular form of water wall spray booth made in accordance with the invention.

BRIEF DESCRIPTION OF THE DRAWING

This booth will be described in relation to the accompanying drawings, in which.

DETAILED DESCRIPTION

Figure 1:
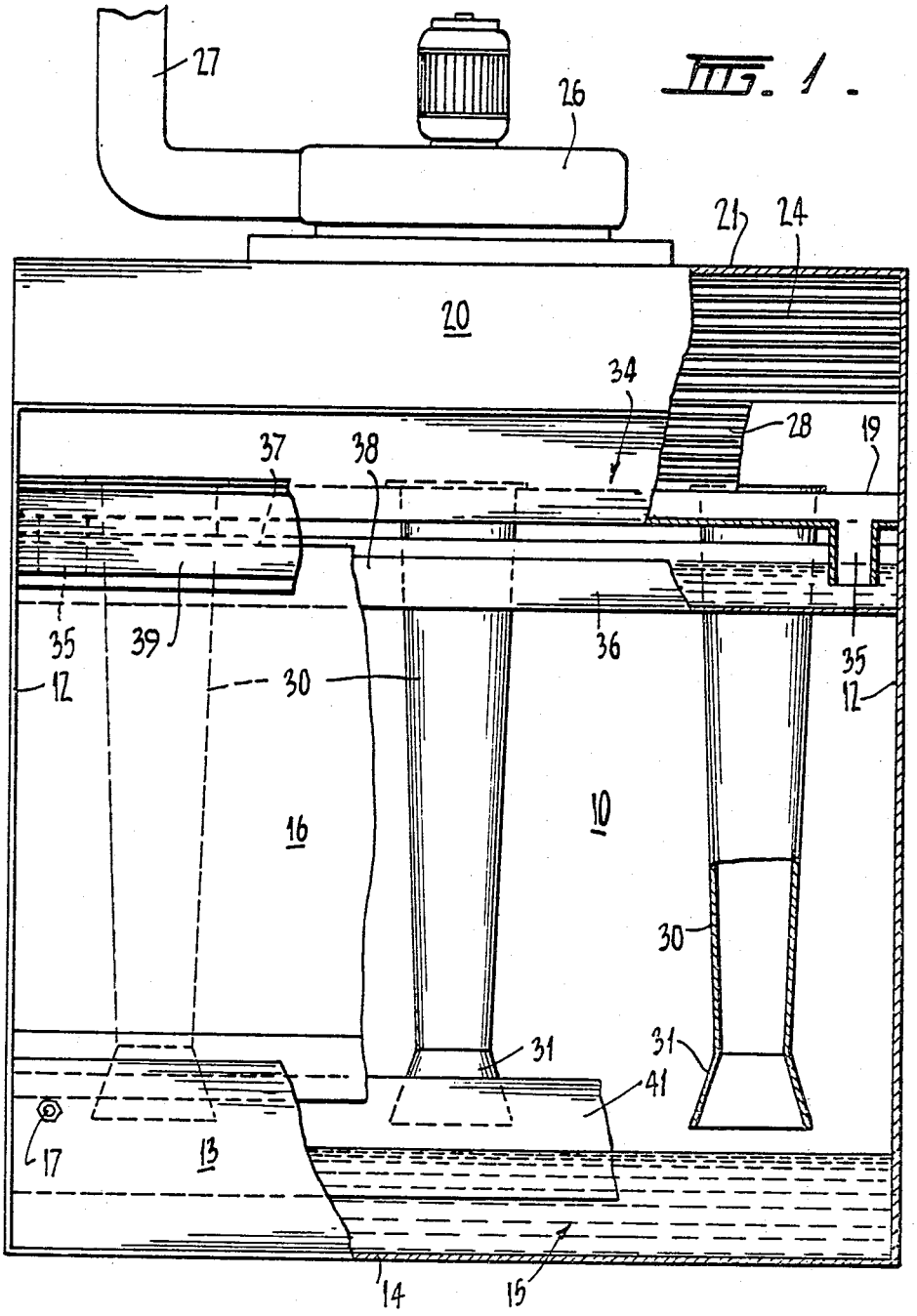
FIG. 1 is a front elevation, partially in section of the booth.

The water wall spray booth may comprise an enclosed, open-fronted, rectangular booth 10 in which or towards which a spray operator is to spray articles and may have in or near its mouth means, not shown, whereby articles to be sprayed can be moved across the front of the booth. This is conventional.

The back 11 and side 12 walls of the booth together with a low front wall 13 positioned across the width of the booth and being connected to the floor 14 and side walls of the booth form a main water reservoir 15 which is adapted to supply water for the water wall 16 to be described hereinafter. This reservoir has a water inlet 17 and level control means 18 which may be a ball valve whereby the required water level may be selected. Approximately three-quarters of the total height of the booth from the ground, although the actual height selected can be varied, there is an intermediate plate 19 which over at least a portion of its depth is parallel to the floor 14 of the booth, which extends across the width thereof and which is connected to the back 11 and two sides 12 of the booth. Between this plate and the top 21 of the booth there is a front cover 20 which is connected to the top 21 of the booth, the intermediate plate 19 and two sides 12 of the booth whereby with the intermediate plate, the rear wall and two sides of the booth provides a chamber 22 which, as will be explained hereafter is an expansion chamber.

Within the expansion chamber 22 and adjacent the rear thereof there is a duct 23 which has a louvre front 24 and a floor 25, the duct being defined by the top 21 and rear wall 11 of the booth. This duct is in connection with an exhaust fan 26 which, in turn, is in connection with an exhaust duct 27 through which air can pass to atmosphere. Also in the expansion chamber there is another set of louvres 28 across the width of the chamber which extend from the intermediate plate 19 to the lower edge of the louvred front 24 of the duct 23.

Extending upwardly from a position in the reservoir 15 to the intermediate plate 19 there is a plurality of ducts 30 which are circular in cross section and which increase in diameter from their lower end to their upper end, although the actual ends 31 are flared outwardly and are of larger diameter than the adjacent duct portion. These ducts may be located by being moved rearwardly into slots formed in the intermediate plate 19 with the slots later being covered.

Figure 2:
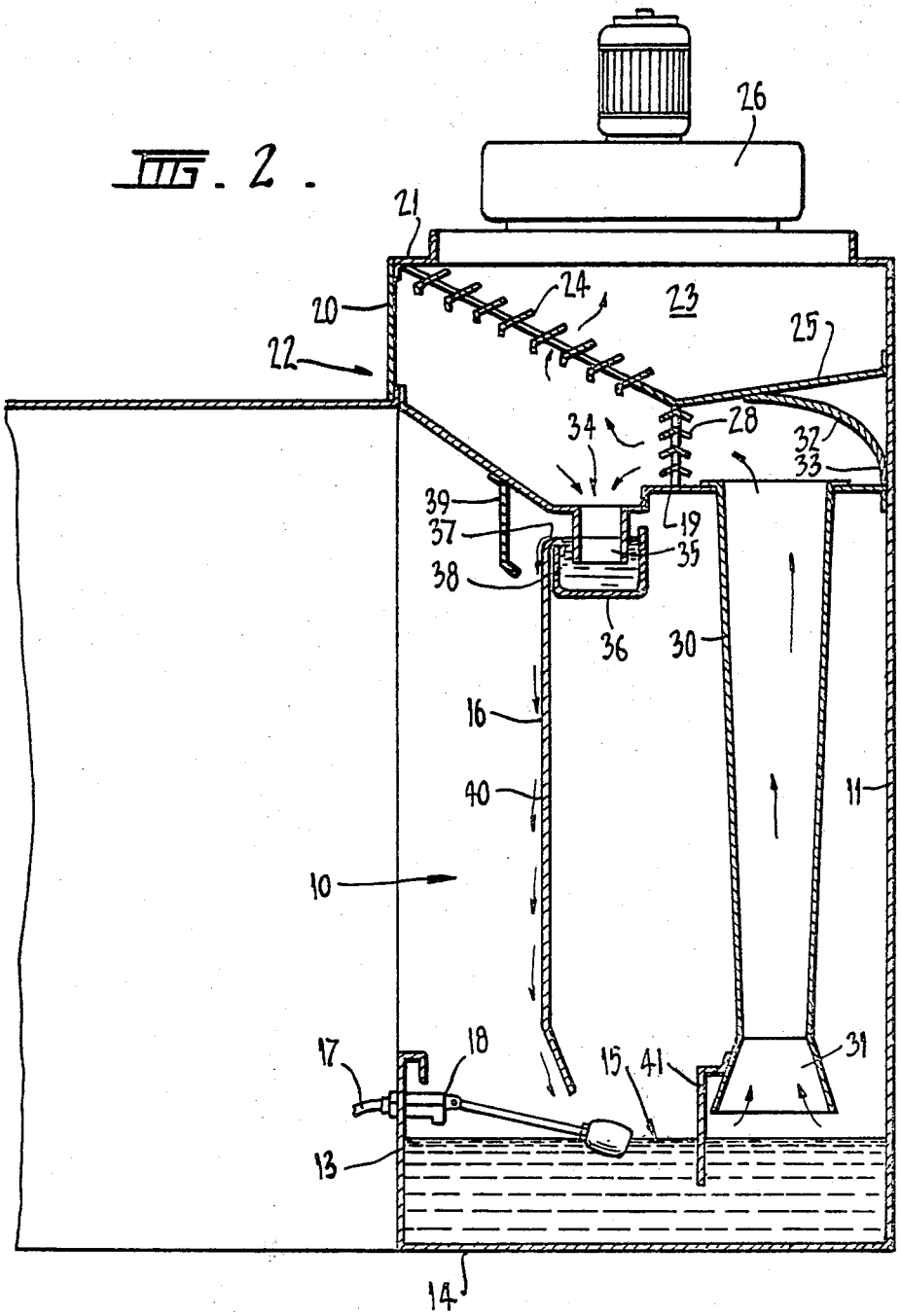
FIG. 2 is a sectional elevation of the booth.

Directly above the open upper mouths of the ducts there is a deflector 32 which extends the full width of the booth, the deflector comprising a downwardly directed portion 33 which is connected to the back 11 and, as illustrated in transverse section, ascan be seen from FIG. 2, is substantially arcuate away from the downwardly directed portion, although the deflector could, in transverse section, be triangular or some other shape. If required, this delfector can, in fact, be formed integrally with the floor 25 of the exhaust duct previously described.

Running across the width of the booth above or in association with the intermediwte plate 19 there is an upper tank 34 into which water leaving the mouths of the circular ducts 30 is collected and this tank 34, at least at each end, has a downwardly directed outlet 35 to enter into a still further transverse tank or trough 36 which is located below the intermediate plate 19. This tank 36, the water wall tank, may be connected on each side of the booth 12 and is spaced below the intermediate plate 19.

The water wall 16 is a sheet of metal which may be curved in a radius, at least along its upper edge 37, and is arranged so that it can simply be hooked over the outer wall 38 of the water wall tank 36.

Forwardly of the water wall tank, close to the front cover, there may be an anti-impingement deflector 39 which is connected to the front edge of the intermediate plate and is downwardly directed to approximately the bottom of the water wall tank.

When the booth is to be used, water is admitted into the lower reservoir 15 until it reaches a predetermined height slightly below the flared lower ends 31 of the water lifting ducts 30, which are circular in transverse section. The fan 26 is started and air is drawn into the booth and passes both above and below the water wall and is drawn downwardly to the flared lower ends 31 of the water lifting ducts 30 where it passes between the water in the reservoir 15 and the flared lower ends of the ducts and upwardly towards the expansion chamber 22.

The arrangement of the ducts 30 and fan 26 is such that water is entrained in the air and carried up the ducts until the air/water mixture strikes the deflector 32 at which time the air and the entrained water are caused to move outwardly over the intermediate plate 19. Because of the louvres 28 this air and water will move forwardly and as the velocity of the air lessens in the expansion chamber 22 the entrained water is released, falls on to the intermediate plate 19 and runs into the top tank 34. The air then passes through the louvres 24 located in the expansion chamber and any liquid water which is still entrained is separated from the air and falls to the intermediate plate 19 and water vapour entrained passes through the exhaust duct 27 to atmosphere. The water from the top tank passes from the outlets 35 of this tank which, as previously indicated, are preferably on each side of the booth, into the water wall tank 36 and when this is full water flows over the wall 16. The cycle is continued with additional water being provided as and where necessary because of the operation of the ball valve 18. When a painter is operating, the over spray strikes the water 40 on the water wall where it is entrained in the water and the heavier particles either sink to the bottom of the reservoir 15 or, if required, are held by flocculant which causes the particles to be held at the upper surface of the reservoir from which they can be floated off. Normally it is preferred that they sink and, if required, the water may be treated to cause them to agglomerate.

Some particles of paint which are entrained in the air may well be carried up in the water lifting ducts 30 and normally these particles will either fall against the air flow in the duct or, alternatively will be carried with the water over the water wall and into the lower reservoir. If the spray painter is relatively close to the wall and is spraying upwardly the anti-impingement deflector 39 will prevent the over-spray from being spread directly into the water wall tank which tends to cause clogging in the tank.

In order to further prevent particles of paint being entrained we may also provide a skirt 41 extending across the width of the booth and connected to the ducts 30 which skirt terminates below the level of the water in the reservoir 15.

The booth of the invention is very much simpler than any previously proposed booths in that the formation of the deflector is simple, that the formation and location of the water lifting ducts is also very simple and the ducts themselves are more efficient than those previously known.

What is claimed is:

1. A water spray booth, comprising (a) housing means including (1) front, rear, side, top and bottom walls defining a chamber; and (2) a generally horizontal intermediate plate (19) extending in spaced relation between said top and bottom walls for dividing said chamber into upper (22) and lower portions;

(3) said front wall containing an inlet opening communicating with said chamber lower portion, said top wall containing an outlet opening communicating with said chamber upper portion;

(b) water reservoir means arranged in the bottom of said chamber lower portion;

(c) means (17, 18) for supplying water to, and for maintaining water at a given level within, said water reservoir means;

(d) at least one vertical duct (30) arranged adjacent said rear wall for conveying water from said reservoir means to said chamber upper portion via a first opening contained in said intermediate plate, the lower portion of said duct terminating at its lower extremity adjacent said given water level, said duct having a circular transverse section, the diameter of the upper portion of said duct progressively increasing in the upward direction;

(e) a unitary deflector plate (32) arranged in said chamber upper portion adjacent said intermediate plate first opening, said deflector plate extending continuously transversely between said side walls and including a rear edge adjacent the junction between said intermediate plate and said rear wall, said deflector plate extending forwardly in spaced relation above said first opening:

(f) said intermediate plate containing at least one second opening (35) forwardly of said first opening;

(g) a horizontal water trough (36) arranged in said lower chamber below and in communication with said second opening, said water trough extending transversely between said side walls;

(h) a generally vertical water wall (16) connected at its upper end with said water trough, said water wall extending downwardly and terminating adjacent said reservoir means for delivering a wall of water from said water trough to said reservoir means; and (i) means (26) applying suction to said housing outlet opening to cause water to be drawn from said reservoir means to said water trough upwardly via said vertical duct and said first opening, forwardly via said deflector plate and chamber upper portion, and downwardly via said second intermediate plate opening, whereby excess water supplied to the trough is returned to the reservoir via said vertical wall.

2. Apparatus as defined in claim 1, and further comprising a plurality of vertical ducts arranged in spaced transverse relation between said side walls.

3. Apparatus as defined in claim 2, wherein the diameter of the lower portion of each of said ducts progressively increases in the downward direction, respectively.

4. Apparatus as defined in claim 3, and further comprising a skirt 41 depending downwardly from and extending transversely in front of the lower portions of said ducts, said skirt further extending into said reservoir means.

5. Apparatus as defined in claim 1, and further comprising first louvre means (28) arranged in said chamber upper portion forwardly of said deflector plate for conveying water through from said deflector plate to said second opening.

6. Apparatus as defined in claim 5, wherein said chamber upper portion includes an upper tank expansion portion (34) arranged forwardly of said first louvre means, and further wherein said intermediate plate contains a pair of second openings, said openings being arranged adjacent said side walls.

7. Apparatus as defined in claim 6, wherein said chamber upper portion further includes an exhaust duct (23) communicating with said outlet opening and second louvre means (24) arranged between said upper tank expansion portion and said duct means.

8. Apparatus as defined in claim 1, wherein said water wall is clipped over the front portion of said water tank means.

9. Apparatus as defined in claim 1, and further comprising a further deflector plate (39) depending downwardly from said intermediate plate forwardly of said water trough.

10. Apparatus as defined in claim 1, wherein said water level maintaining means comprises a ball valve.

* * * * *